US006854997B2

(12) United States Patent
Stockhaus

(10) Patent No.: US 6,854,997 B2
(45) **Date of Patent: *Feb. 15, 2005**

(54) DEVICE FOR UNLOCKING AN ELECTRONIC COMPONENT THAT IS INSERTIBLE INTO A RECEIVING DEVICE

(75) Inventor: Andreas Stockhaus, Berlin (DE)

(73) Assignee: Infineon Technologies AG, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/613,350

(22) Filed: Jul. 3, 2003

(65) Prior Publication Data

US 2004/0005803 A1 Jan. 8, 2004

Related U.S. Application Data

(62) Division of application No. 09/705,607, filed on Nov. 3, 2000, now Pat. No. 6,612,858.

(51) Int. Cl.[7] ..... H01R 13/627

(52) U.S. Cl. ..... 439/352; 439/353; 439/354; 361/728

(58) Field of Search ..... 439/352–357; 361/725–728, 732, 754, 759, 740

(56) References Cited

U.S. PATENT DOCUMENTS 5,772,461 A 6/1998 Yu
6,095,843 A 8/2000 Kaneko et al.
6,612,858 B1 * 9/2003 Stockhaus ..... 439/352

FOREIGN PATENT DOCUMENTS

| | | |
|---|---|---|
| DE | 33 32 658 C2 | 3/1985 |
| DE | 42 44 680 A1 | 11/1993 |
| DE | 198 47 843 A1 | 5/2000 |
| EP | 1 001 498 A2 | 5/2000 |
| EP | 1 048 965 A2 | 11/2000 |

* cited by examiner

*Primary Examiner*—Khiem Nguyen
(74) *Attorney, Agent, or Firm*—Laurence A. Greenberg; Werner H. Stemer; Gregory L. Mayback

(57) ABSTRACT

An apparatus for unlocking an electronic component to be inserted into a retaining device, in particular, a transceiver, and held in the retaining device by a locking element, such as a tongue. The apparatus has an unlocking device is integrally formed with the component housing or with a part thereof. The unlocking device is a rocker formed as part of the component and has an unlocking part for moving the unlocking device into an operated position and for unlocking the locking element in that position. An integral reset spring, which can be a leaf or torsion spring, connects the rocker. The operating direction is at right angles to a removal or ejection direction of the component from the retaining device. Preferably, the unlocking device and the component are plastic. The unlocking apparatus allows easily controllable removal of a component, is of simple construction, and can be produced cost-effectively.

42 Claims, 11 Drawing Sheets

Prior Art

DEVICE FOR UNLOCKING AN ELECTRONIC COMPONENT THAT IS INSERTIBLE INTO A RECEIVING DEVICE

CROSS-REFERENCE TO RELATED APPLICATION

This application is a divisional of U.S. application Ser. No. 09/705,607, filed Nov. 3, 2000 now U.S. Pat. No. 6,612,858.

BACKGROUND OF THE INVENTION

Field of the Invention

The invention relates to an apparatus for unlocking an electronic component, which can be inserted into a retaining apparatus, in particular, a transceiver, which is held in the retaining apparatus by a locking element, with the apparatus having unlocking means for unlocking the locking element, where the unlocking means are formed integrally with the housing or with a part of the housing of the component. It is particularly suitable for unlocking transceivers that are inserted in a sheet-metal structure disposed on a printed circuit board and are latched to the structure (pluggable transceiver).

It is known for electronic transceivers to be inserted into a sheet-metal structure that is disposed on a printed circuit board. Such configurations are used, in particular, in so-called small form factor (SFF) pluggable transceivers that are physically small. An unlocking apparatus is provided for removing the transceiver from the sheet-metal structure, operates a latching element, and, thus, allows the transceiver to be removed.

A corresponding configuration is shown in FIG. 5. To couple a transceiver 1 to the connections of a printed circuit board 3, the transceiver is pushed into a housing 2 that is connected to the printed circuit board 3. The housing 2 forms a sheet-metal cage that is normally composed of copper alloy or steel alloy and is formed from a lower part 21, connected to the printed circuit board, and an upper part 22 that can be placed on the lower part. A plug part 6 disposed in the housing is used to make contact with corresponding contacts on the transceiver 1. The transceiver 1 has electronic transducers in a manner known per se, such as a Fabry-Perot Laser or VCSEL laser and a photodiode.

A sheet-metal tongue 5 is provided on the lower part 21 of the housing 2 to secure the transceiver 1 in the housing 2 and, once the transceiver 1 has been pushed into the housing 2, latches behind a latching tab disposed on the bottom face of the transceiver 1 and, thus, locks the transceiver 1 in the housing 2. To remove the transceiver 1 from the housing 2 once again, a separate unlocking element 4 is provided according to the prior art, which pushes the sheet-metal tongue 5 downwards when it is operated, and, thus, unlocks the transceiver 1.

This relationship is shown in more detail in FIGS. 6*a* and 6*b*. The section view in FIG. 6*a* and the bottom view shown in FIG. 6*b* show a latching tab 7 on the housing of the transceiver 1, behind which the sheet-metal tongue (see FIG. 6) comes to rest when the transceiver 1 is latched in. The separate unlocking element 4, which is formed by a slide 4, is provided for unlocking. The slide 4 can be moved in the direction of the latching tab 7 and, when moved appropriately, has inclined unlocking tabs 41 that engage under the sheet-metal tongue 5 so that the latter is pressed away downward and breaks contact with the latching tab 7. The transceiver 1 is, now, unlocked and can be removed from the connection housing 2.

A first disadvantage of the known configuration is that the moving slide must be attached to the transceiver housing separately. Secondly, the unlocking element is operated in the direction opposite the movement direction when the transceiver is being removed, that is to say, the operating direction is in the wrong sense because a part that is attached to the housing must be pushed in a direction opposite to the removal direction. A further disadvantage of the known configuration is that the unlocking element must be moved through several millimeters along the bottom face of the transceiver, and is, thus, difficult to reach and operate.

SUMMARY OF THE INVENTION

It is accordingly an object of the invention to provide an apparatus for unlocking an electronic component, which can be inserted into a receiving apparatus, in particular, a transceiver, that overcomes the hereinafore-mentioned disadvantages of the heretofore-known devices of this general type and that allows easily controllable removal of the component, is of simple construction, and can be produced cost-effectively.

According to the invention, an unlocking apparatus for unlocking an electronic component that can be inserted into a retaining apparatus, in particular, a transceiver, which is held in the retaining apparatus by a locking element, has unlocking means for unlocking the locking element, the unlocking means being formed integrally with the housing or with a part of the housing of the component.

Accordingly, the invention provides that, to unlock a locking element of the retaining apparatus, the unlocking means are formed integrally with the housing of the component or with a part of the housing of the component. Because the unlocking means and the housing are integral, this results in an integral solution that integrates the unlocking means in the housing and, thus, saves an additional part in comparison to the prior art. The production cost is, thus, reduced and assembly is also simplified because the unlocking means no longer need be fitted to the housing. This, thus, provides a simple and cost-effective solution.

In one preferred embodiment of the invention, the unlocking means have a rocker that is formed on the housing or housing part. The rocker in this case includes an operating part, which can be operated by an operator for unlocking, and an unlocking part. When the operating part has not been operated, the rocker is located in an un-operated position. When the operating part is operated, the rocker moves to an operated position, in which the locking element is unlocked. The use of a rocker to initiate unlocking of the component provides a simple and cost-effective solution. The operating part is, preferably, lengthened or bent such that it is easily accessible to, and can correspondingly be operated easily by, an operator.

In one preferred development, the rocker is connected to at least one resetting means, in particular, a reset spring. The resetting means, for example, a leaf spring or a torsion spring, is, preferably, likewise formed integrally with the housing, or with a part of the housing of the component. The use of a reset spring ensures that the component is unlocked only when the operating part of the rocker is operated and that the component is, otherwise, securely latched in the retaining apparatus. The resetting means that is used engages on the rocker, preferably, in the region of the rotation axis or tilting axis of said rocker, to ensure that the rocker is reset to the un-operated state in a simple manner. The resetting means, preferably, results in the rocker being connected to the housing or housing part of the component in this case.

In one preferred refinement of the invention, the operating part of the rocker is disposed in the region of the optical inlet in the transceiver. As such, the operating part is easily accessible and simple to operate. To avoid reducing the size of the retaining opening in the optical inlet by the configuration of the operating part, the optical inlet, preferably, has an elongated depression, which at least partially accommodates the operating part and, if appropriate, the unlocking part as well. Because the unlocking part in such a configuration is disposed in the interior of the housing, the housing wall has an opening through which the unlocking part makes contact with the locking element in the operated state so that the unlocking process can be carried out.

In one further advantageous refinement of the invention, the operating part and the unlocking part are formed in the bottom face of the housing of the component. Consequently, the unlocking part is immediately adjacent to the locking element, which can be operated when required.

The operating direction of the operating part is, preferably, at right angles to the removal direction of the component, or even in the removal direction of the component. Such an operating direction can be provided by suitable configuration of the rocker, which is, preferably, in the form of the unlocking apparatus. An operating direction at right angles to or even in the removal direction of the component avoids the situation in the prior art where a movement in the opposite direction to the removal direction must, first of all, be carried out for unlocking.

The unlocking apparatus according to the invention and the housing are, preferably, manufactured integrally from plastic, for example, using the cost-effective injection-molding method.

Other features that are considered as characteristic for the invention are set forth in the appended claims.

Although the invention is illustrated and described herein as embodied in device for unlocking an electronic component that is insertible into a receiving device, it is nevertheless not intended to be limited to the details shown because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Figure 5:
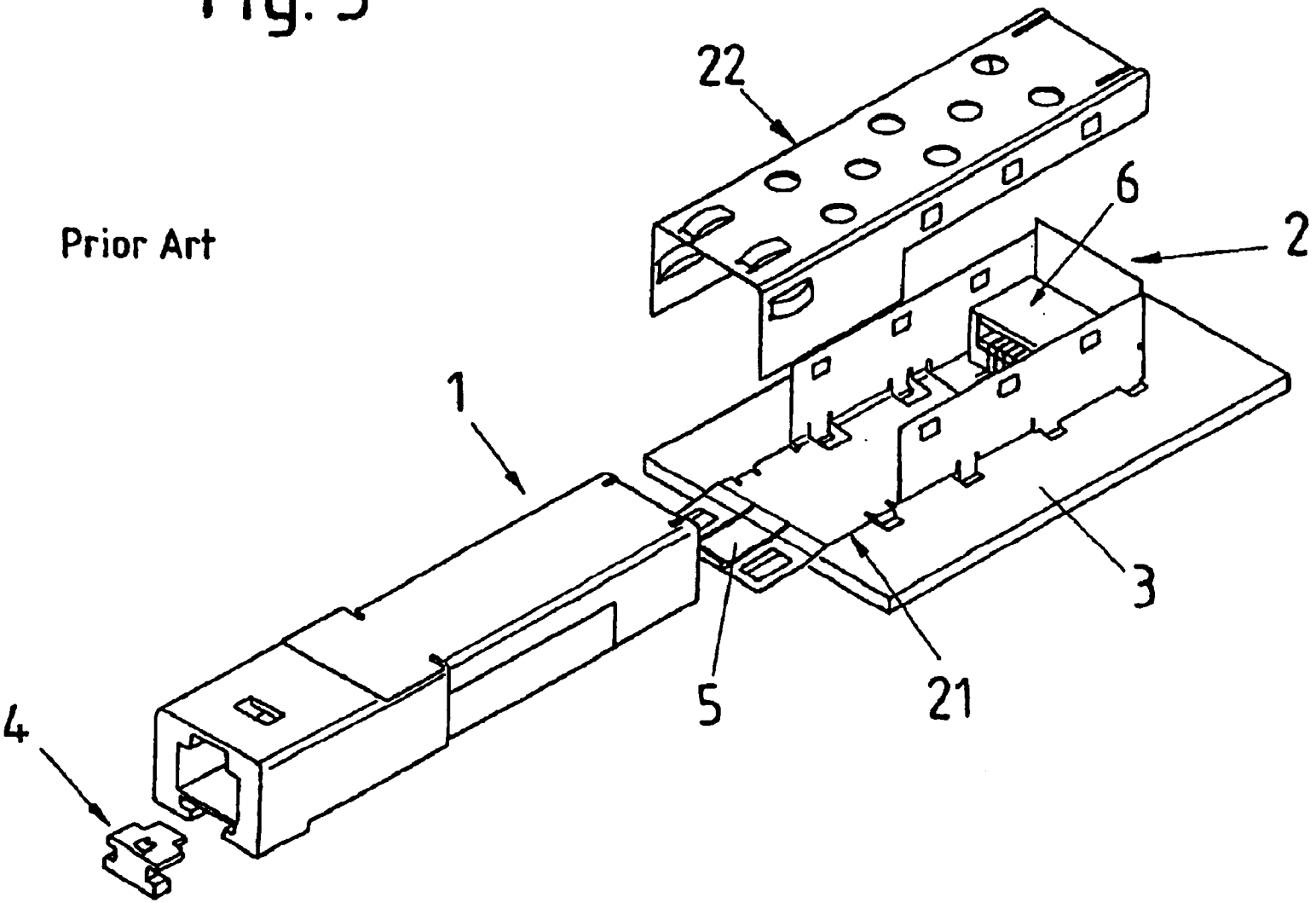
Fig. 5 Prior Art
FIG. 5 is an exploded, perspective view of prior art transceiver and unlocking apparatus.
Figure 6A:
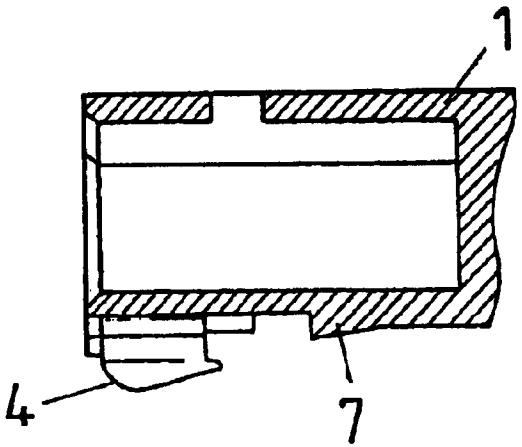
FIG. 6*a* is a fragmentary, cross-sectional view of the transceiver and of the unlocking apparatus of FIG. 5.
Figure 6B:
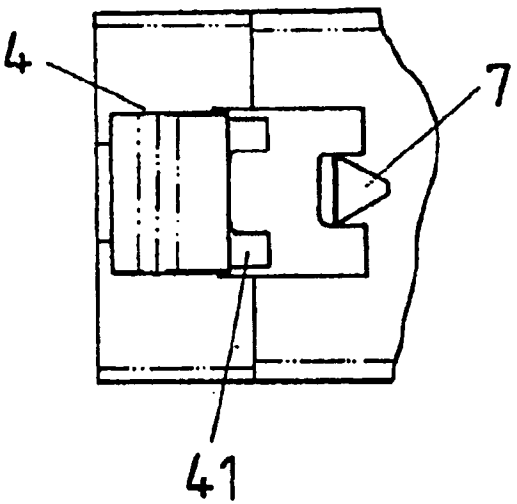
Prior Art Fig. 6b
FIG. 6*b* is a fragmentary, bottom view of the transceiver and of the unlocking apparatus of FIG. 5.

A transceiver with the unlocking apparatus according to the prior art was explained in the introduction, with reference to FIGS. 5, 6*a*, and 6*b*.

Figure 1:
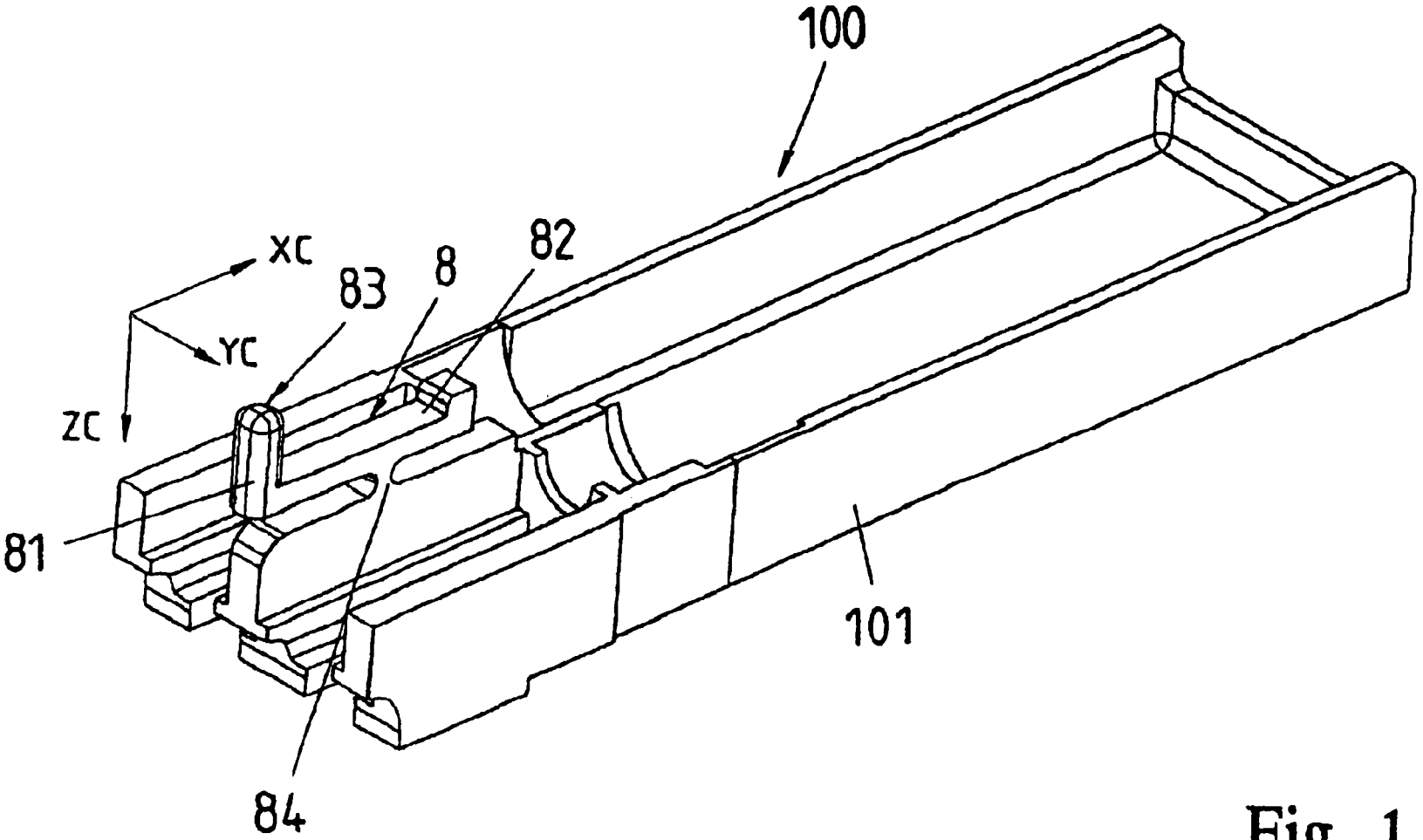
FIG. 1 is a perspective view of a housing lower part of a transceiver with an unlocking apparatus according to the invention.

Referring now to the figures of the drawings in detail and first, particularly to FIG. 1 thereof, there is shown an unlocking apparatus 8 according to the invention, which is formed integrally with a housing lower part 101 of a transceiver 100. The unlocking apparatus 8 and the housing lower part 101 are, preferably, composed of a plastic and are formed jointly.

The unlocking apparatus 8 is in the form of a rocker that has a front operating part 81, facing an operator, and an unlocking part 82. At its end, the operating part 81 is bent 90°, thus, forming an operating surface 83 that can easily be operated by an operator. On its head part, the unlocking part 82 of the rocker 8 forms a pushing surface, which presses against a locking element when the operating part 81 is being operated and, consequently, results in unlocking, as will be described below.

The rocker 8 is connected to the housing lower part 101 through a web 84. The web 84, in this case, forms the rotation or tilting axis of the rocker 8, that is to say, when the operating part 81 is being operated, the rocker 8 tilts about the axis that is governed by the web 84 so that the tongue 82 is moved upward when the projection 83 is pressed downward.

At the same time, the web 84 is in the form of a leaf spring and, thus, represents a reset spring that ensures that the rocker 8 is always in a defined initial position when in the un-operated state.

Figure 2A:
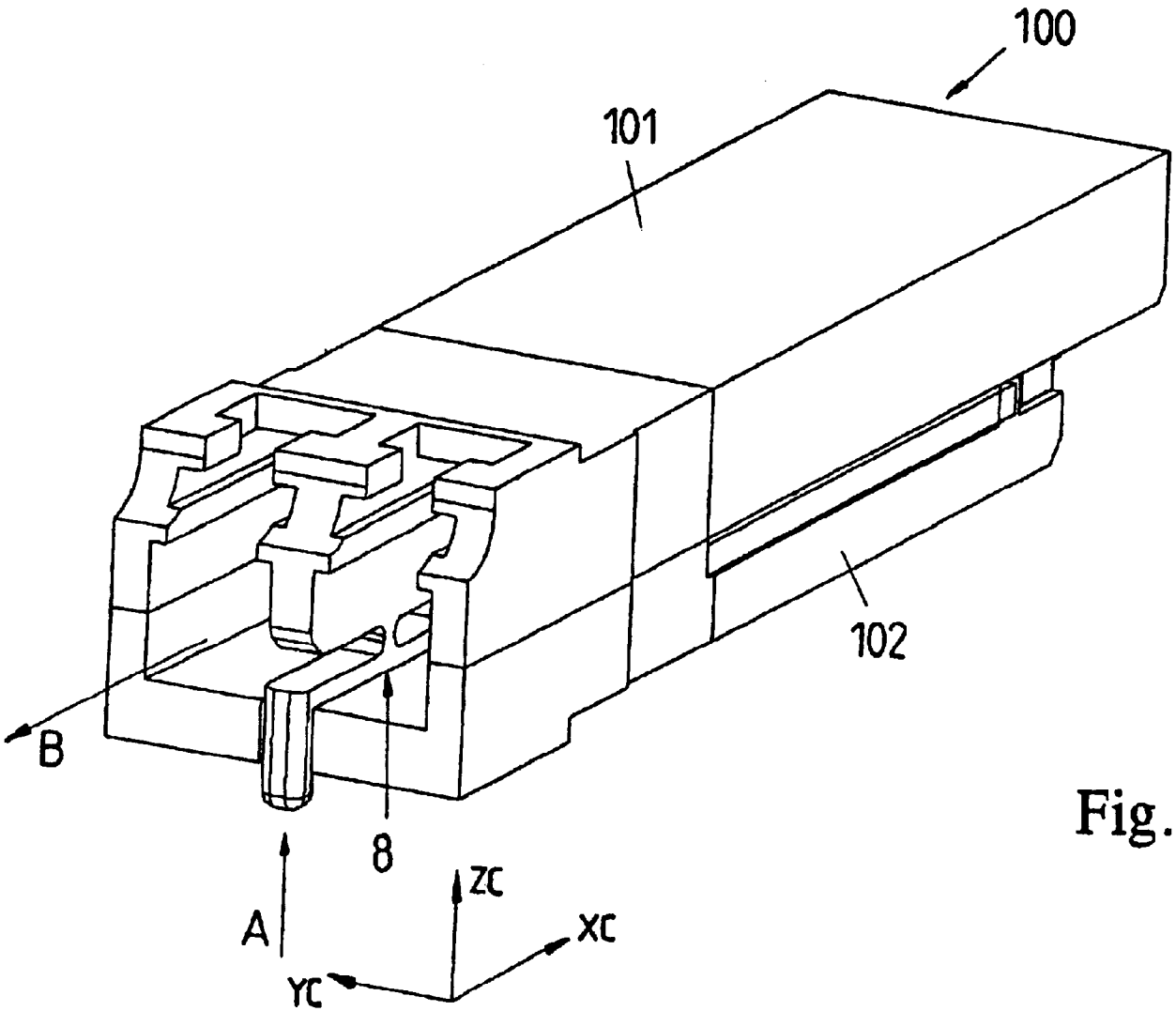
FIG. 2*a* is a perspective view of a complete transceiver with the unlocking apparatus of FIG. 1, illustrated in a first form.

FIG. 2*a* shows the complete transceiver 100, in which a housing upper part 102 is placed on the housing lower part 101. The two housing parts are, for example, mechanically bonded to one another. In such a case, it is irrelevant to the invention whether two or more housing parts are provided or even if the housing is integral. The only significant feature is that the unlocking apparatus is formed integrally with at least a part of the housing.

Figure 2B:
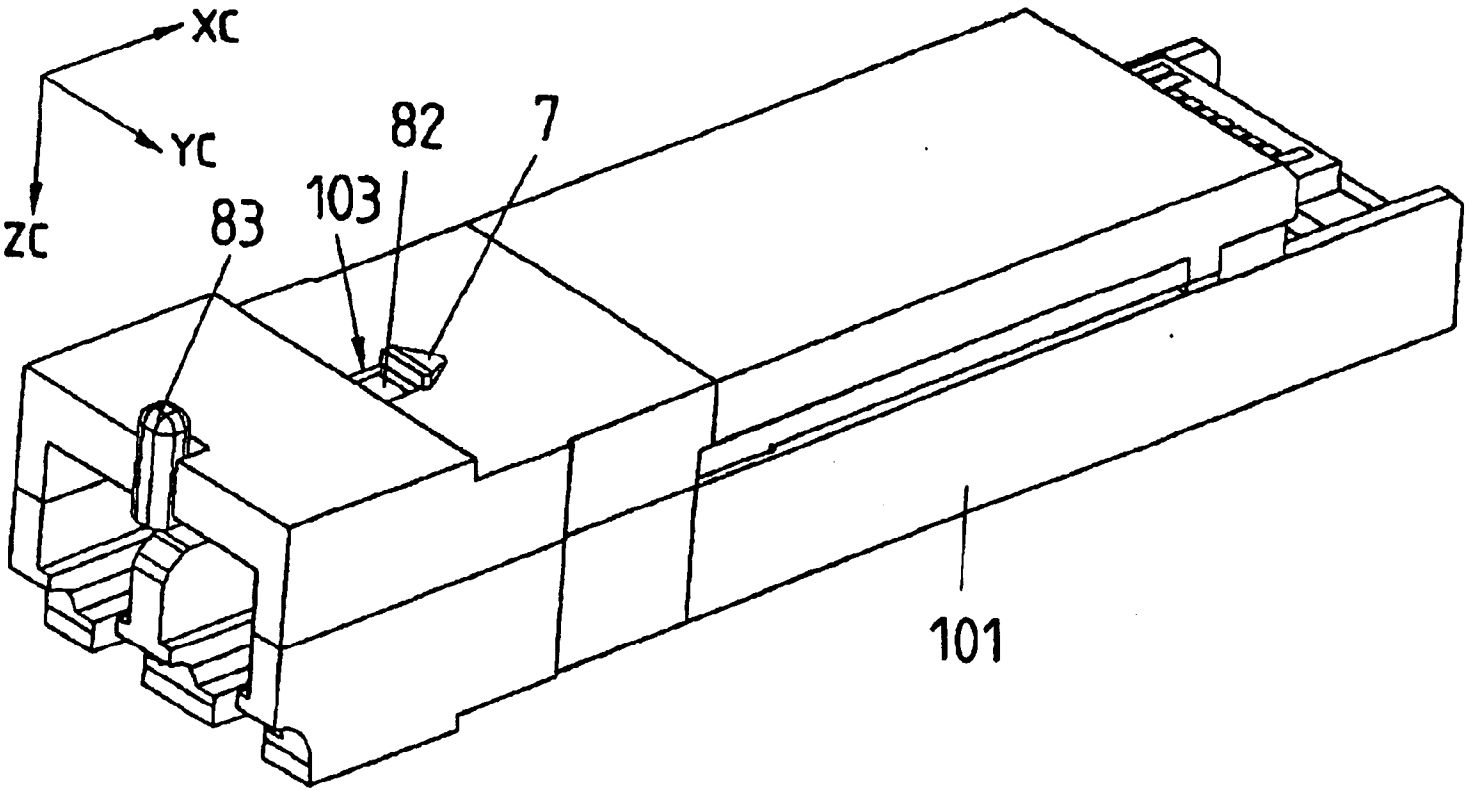
FIG. 2*b* is a perspective view of a complete transceiver with the unlocking apparatus of FIG. 1, illustrated in a second form, rotated through 180° with respect to the view in FIG. 2*a;*

According to FIG. 2*b*, the housing upper part 102 has an opening 103 that accommodates the head part of the unlocking part 82 of the rocker 8. This ensures that, when the operating part 81 is being operated, the head part of the unlocking part 82 moves substantially at right angles to the surface of the housing 102, and out of the latter so that a locking part, which rests on the head part, of a retaining apparatus for the transceiver 1, located behind a latching tab 7, can be unlocked.

In FIG. 2*a*, it can easily be seen that the operating direction A for unlocking the transceiver 100 runs at right angles to the ejection direction or removal direction B of the transceiver 100.

Figure 3:
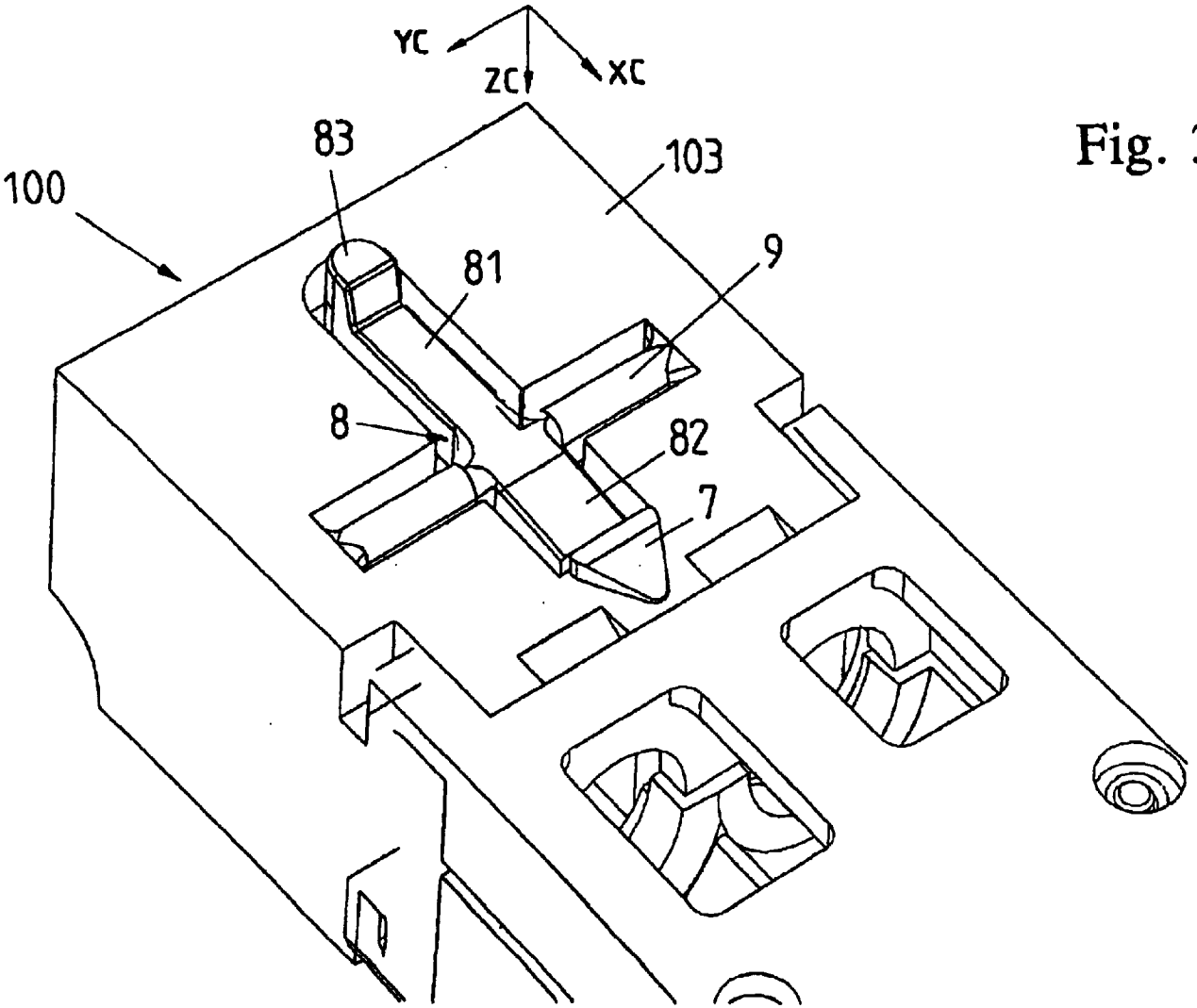
FIG. 3 is a fragmentary, perspective view of a subregion of a transceiver housing with a second embodiment of the locking apparatus according to the invention.

FIG. 3 shows an alternative embodiment of an unlocking apparatus that is integrally connected to a transceiver housing. According to FIG. 3, the unlocking apparatus is, once again, in the form of a rocker 8, which includes an operating part 81 with an operating surface 83 and an unlocking part 82 with a contact surface. The rocker 8 in this embodiment is cut directly into the housing surface of a housing part 103 of the transceiver 100. In such a case, it is connected to the housing 103 in a sprung manner through a torsion spring 9. For such a purpose, the torsion spring 9 is connected to the housing part 103, firstly, in the region of the rotation axis of the rocker 8 and, secondly, at its lateral ends. The torsion spring 9 is, in this case, formed by a round plastic rod.

When the operating surface 83 is operated, the rocker 8 tilts about the axis governed by the torsion spring 9. In the process, firstly, the operating part 82 is moved upward. Secondly, the torsion spring 9 is twisted so that the rocker 8 automatically returns to its initial position when the operating part 81 is released.

In FIG. 3, it is also easy to see a latching tab 7 on the housing part 103, behind which, in the locked state, a sheet-metal tongue (which is used as the locking element) of a retaining apparatus for the transceiver 100 comes to rest. When the operating part 81 is being operated, thus, resulting in the unlocking part 82 being raised, such a sheet-metal tongue is moved away vertically upward from the housing surface and is, thus, disengaged from the latching tab 7 so that the transceiver 100 can be removed from the retaining apparatus.

Because the operating surface 83 of the operating part 81 projects from the surface of the housing part 103, the unlocking apparatus can be operated in a simple manner.

Figure 4A:
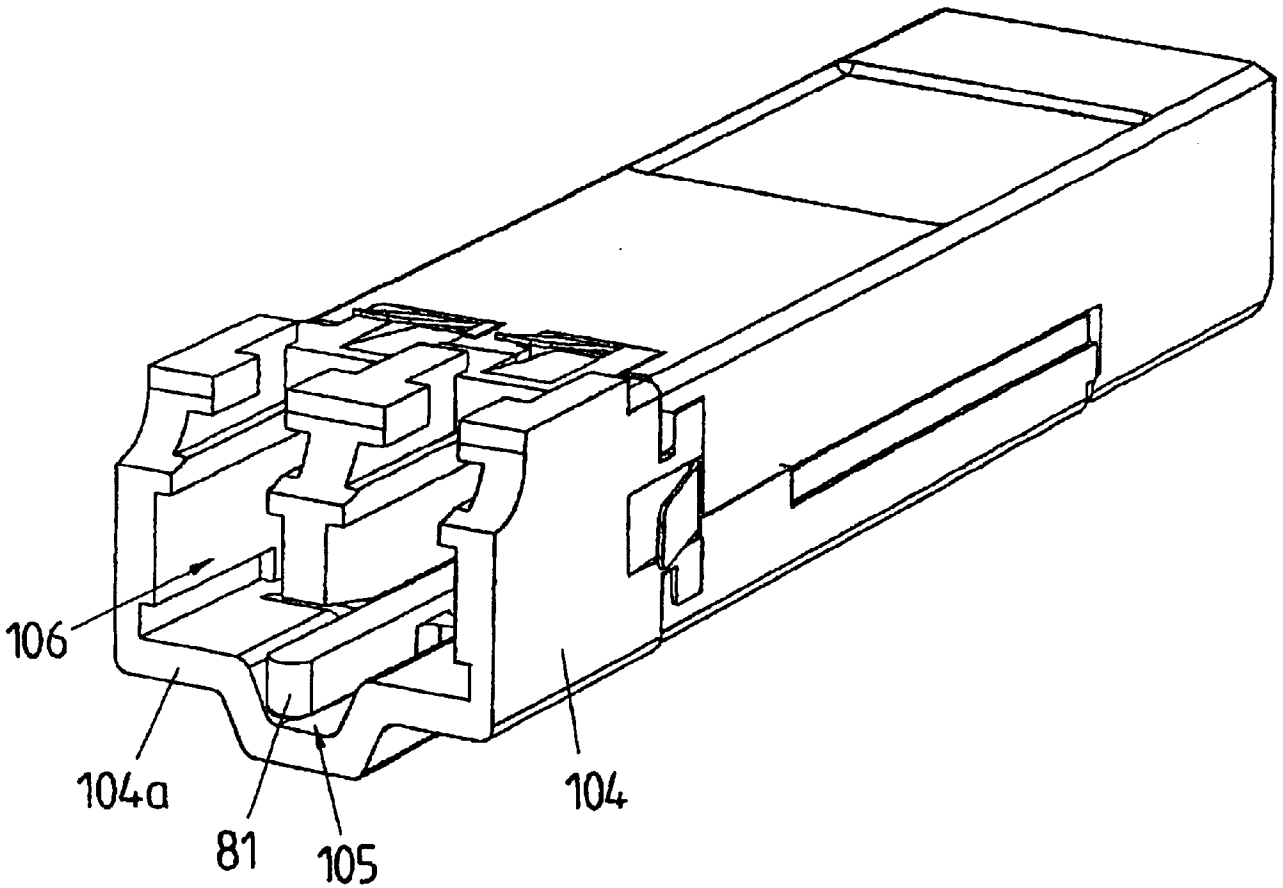
FIG. 4*a* is a perspective view of a transceiver with an unlocking apparatus as shown in FIG. 1, with the unlocking apparatus being accommodated in a longitudinally running depression in the housing.

FIG. 4*a* shows a further exemplary embodiment of the invention, in which the unlocking apparatus is, in principle, in the form described with reference to FIG. 3. One difference is that the bottom face 104*a* of the housing part 104 has, in the center, a depression or groove 105 that runs in the longitudinal direction and that substantially contains the operating part 81 of the rocker. This ensures that the optical inlet 106 of the transceiver, which is used to accommodate the optical plugs, is not reduced in size by the operating element 81.

Figure 4B:
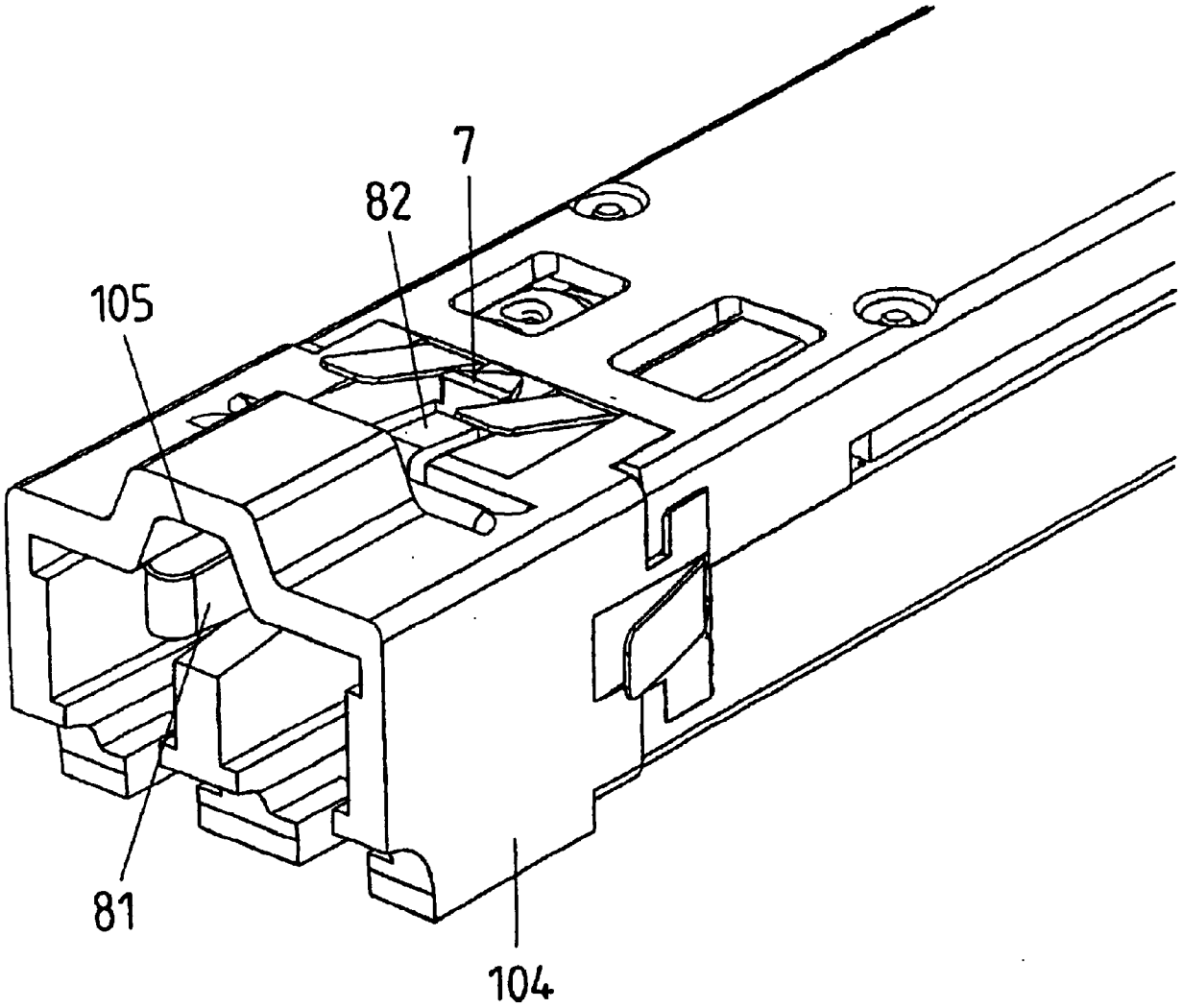
FIG. 4*b* is a fragmentary, perspective view of the transceiver from FIG. 4*a* illustrated rotated through 180°.

FIG. 4*b* shows a view of the transceiver 100 rotated through 180°, in which the unlocking part 82 and the latching tab 7 can also be seen, in addition to the operating part 81 disposed in the groove 105.

Figure 4C:
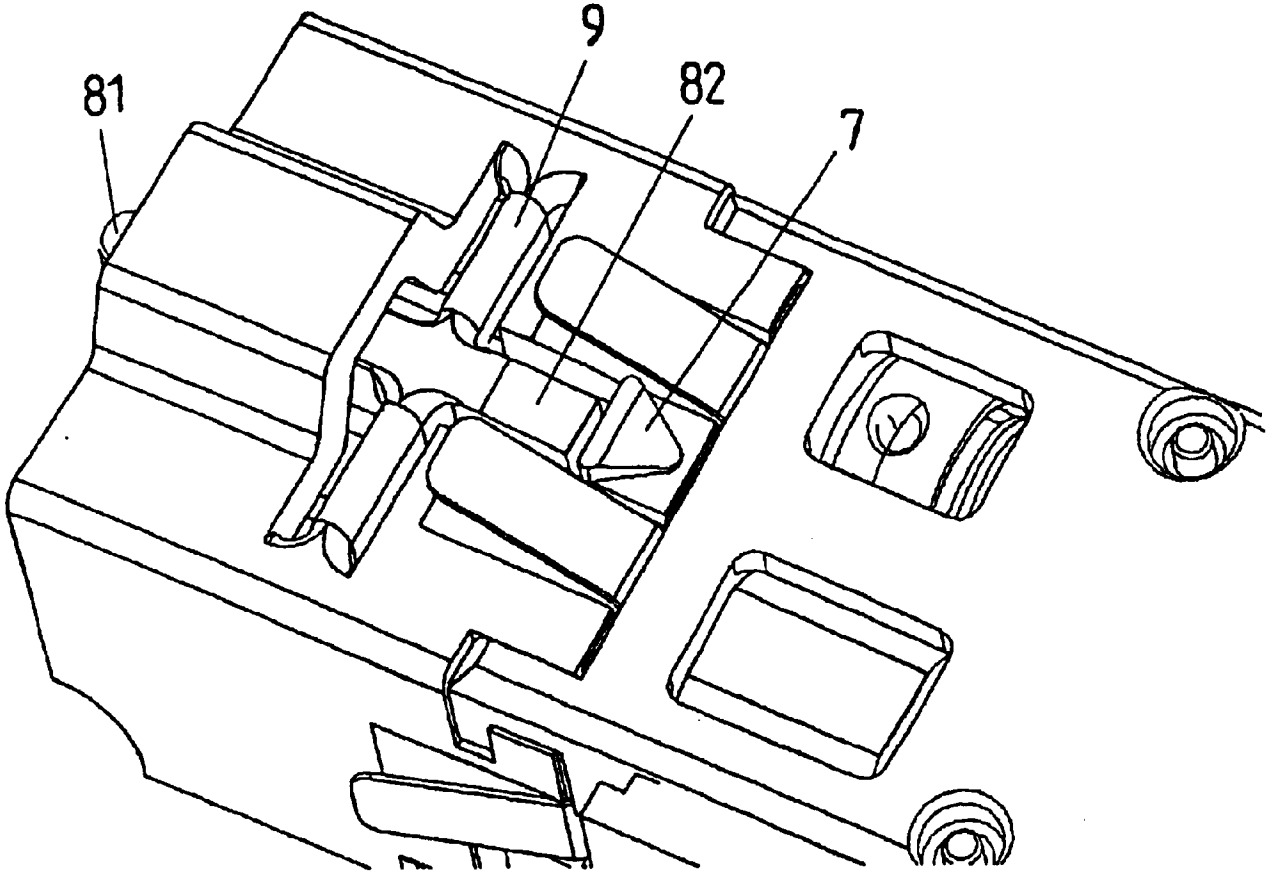
FIG. 4*c* is a fragmentary, perspective view of an enlarged detail of the transceiver shown in FIGS. 4*a* and 4*b;*

According to FIG. 4*c*, a reset spring 9 is provided, which is formed in a corresponding manner to the reset spring in FIG. 3.

Figure 7:
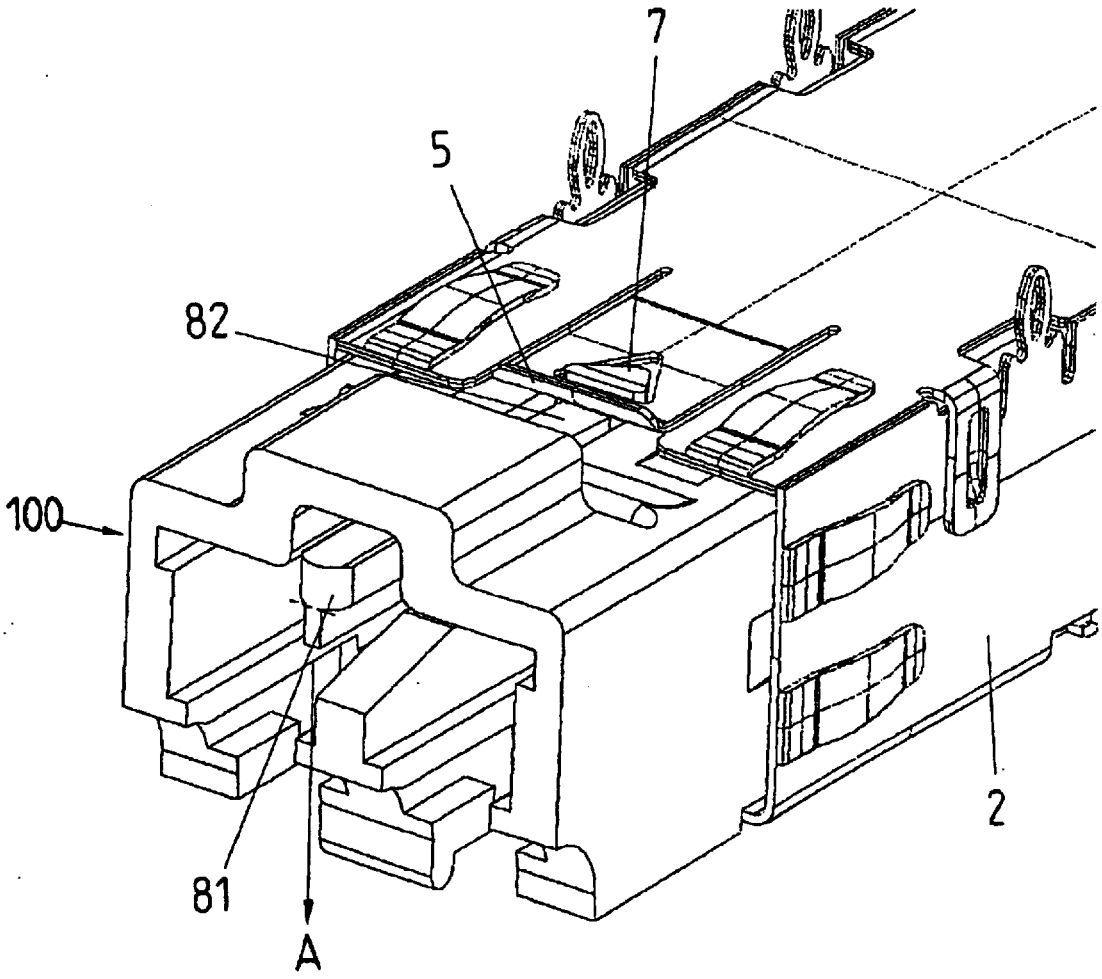
FIGS. 7 and 8 are fragmentary, perspective views of the transceiver inserted into a housing with the unlocking apparatus according to the invention being accommodated in a longitudinally running groove in the housing.
Figure 8:
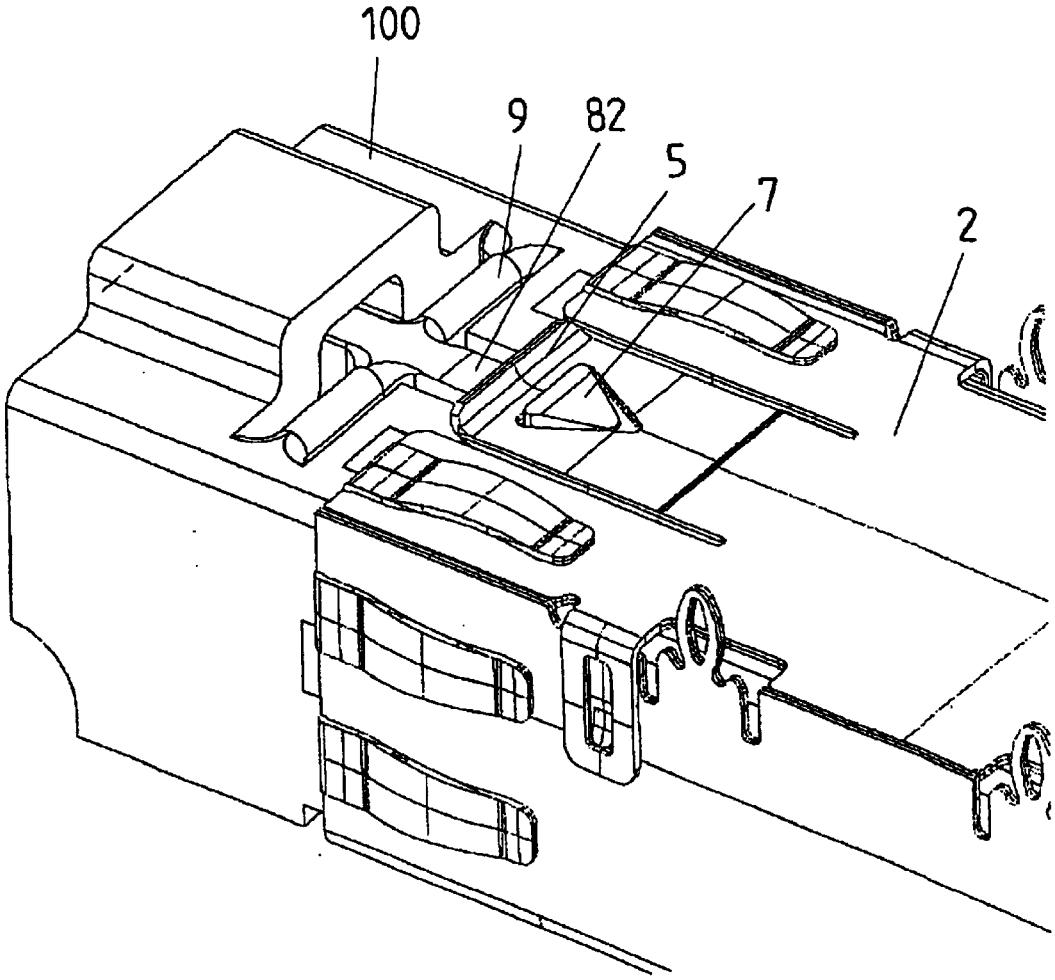

Once the transceiver 100 has been inserted completely into a housing 2, as shown in FIGS. 7 and 8, a sheet-metal spring 5 on the housing latches in behind the latching tab 7 of the transceiver 100, and, thus, locks the transceiver 100 to the housing 2. All that is required to release the lock is to press the easily accessible operating part 81 slightly vertically upward in the direction of the arrow A. As a result, the unlocking part 82 presses the sheet-metal tongue away from the latching tab 7, overcoming the locking of the transceiver 100 to the housing 2.

The embodiment of the invention is not limited to the exemplary embodiments described above. The only significant feature for the invention is that the unlocking means of the unlocking apparatus are formed integrally with the housing or with a housing part of an electronic component.

I claim:

1. An apparatus for locking and unlocking an electronic component to be inserted into a retaining device and held in the retaining device, the apparatus comprising:

a rocker to be operatively connected to the electronic component and movable between a first position and a second position, said rocker having a first end interacting with the retaining device and a second end for operating said rocker, said first end unlocking the electronic component in the retaining device when placed in said second position.

2. The apparatus according to claim 1, wherein said first position is an initial position and said second position is an operated position.

3. The apparatus according to claim 1, wherein:

the electronic component has at least one part; and said rocker is integrally formed with the at least one part.

4. The apparatus according to claim 1, including at least one resetting means connecting said rocker to the electronic component.

5. The apparatus according to claim 4, wherein said at least one resetting means is integrally formed with the electronic component.

6. The apparatus according to claim 4, wherein the electronic component has a part and said at least one resetting means is integrally formed with the part.

7. The apparatus according to claim 5, wherein:

said rocker has a rotation axis; and said at least one resetting means is a leaf spring connected to said rocker at a region of said rotation axis.

8. The apparatus according to claim 4, wherein:

said rocker has a rotation axis; and said at least one resetting means is a torsion spring connected to said rocker at a region of said rotation axis.

9. The apparatus according to claim 1, wherein said second end has an operating direction at least one of right angles to and in the removal direction of the electronic component from the retaining device.

10. The apparatus according to claim 1, wherein:

the electronic component has a longitudinal axis; and said second end has an operating direction perpendicular to the longitudinal axis.

11. The apparatus according to claim 1, wherein:

the electronic component is removed from the retaining device in a removal direction; and said second end has an operating direction perpendicular to the removal direction.

12. The apparatus according to claim 1, wherein:

the electronic component leaves the retaining device in an ejection direction; and said second end has an operating direction perpendicular to the ejection direction.

13. The apparatus according to claim 1, wherein:

the electronic component has a surface; and said second end has an operating direction perpendicular to the surface of the electronic component.

14. The apparatus according to claim 1, wherein the electronic component is a transceiver.

15. The apparatus according to claim 14, wherein:

the transceiver has an optical inlet; and said second end is disposed at the optical inlet.

16. The apparatus according to claim 15, wherein the optical inlet has an elongated depression accommodating said second end.

17. The apparatus according to claim 15, wherein:

the electrical component has a housing wall defining an opening;

said first end is disposed at the optical inlet; and said first end contacts the locking element in said second position through the opening.

18. The apparatus according to claim 15, wherein:

the electrical component has a housing with a bottom face; and said second end and said first end are disposed on the bottom face.

19. The apparatus according to claim 15, wherein the retaining device is a metal structure to be fitted on a printed circuit board.

20. The apparatus according to claim 15, wherein the retaining device is a sheet-metal cage to be fitted on a printed circuit board.

21. The apparatus according to claim 15, wherein:

said rocker is integral to the electronic component; and the electronic component and said rocker are plastic.

22. The apparatus according to claim 15, wherein:

the electronic component has a part;

said rocker is integral to the part; and the electronic component, the part, and said rocker are plastic.

23. The apparatus according to claim 1, wherein:

said second end and said first end are disposed on opposite ends of said rocker.

24. The apparatus according to claim 23, wherein:

said rocker has a rotation axis disposed between said second end and said first end; and a control spring is connected to said rocker in a vicinity of said rotation axis.

25. A method for unlocking an electronic component held in a retaining device, the method comprising:

moving a rocker from an unoperated position to an operated position by operating an operating part of the rocker, thereby causing an unlocking part of the rocker to unlock the electronic component from the retaining device.

26. The method according to claim 25, wherein the rocker has a rotation axis and the rocker is rotated about the rotation axis when being moved from the unoperated position to the operated position.

27. The method according to claim 25, further comprising resetting the rocker to the unoperated position.

28. The method according to claim 25, wherein the electronic component has a longitudinal axis and the operating part of the rocker is operated in a direction perpendicular to the longitudinal axis.

29. The method according to claim 25, wherein the electronic component has a removal direction from the retaining device and the operating part of the rocker is operated in a direction perpendicular to the removal direction.

30. The method according to claim 25, wherein the electronic component has a surface and the operating part of the rocker is operated in a direction perpendicular to the surface of the electronic component.

31. The method according to claim 26, wherein the rotation axis is located between the unlocking part and the operating part of the rocker.

32. The method according to claim 25, wherein the unlocking part of the rocker, when the rocker is moved to the operated position, changes its position with respect to a housing wall of the retaining device.

33. The method according to claim 25, wherein the unlocking part of the rocker, when the rocker is moved to the operated position, changes interaction with the retaining device.

34. A method for locking and unlocking an electronic component to be inserted in a retaining device and held in the retaining device, the method comprising:

providing a rocker which is movable between an unoperated position and an operated position;

locking the electronic component in the retaining device when the rocker is in the unoperated position; and unlocking the electronic component from the retaining device by moving the rocker to the operated position.

35. The method according to claim 34, wherein the rocker is moved to the operated position by operating an operating part of the rocker, thereby causing an unlocking part of the rocker to unlock the electronic component from the retaining device.

36. The method according to claim 34, further comprising resetting the rocker to the unoperated position after having moved the rocker to the operated position.

37. The method according to claim 34, wherein the electronic component has a longitudinal axis and the operating part of the rocker is operated in a direction perpendicular to the longitudinal axis.

38. The method according to claim 34, wherein the electronic component has a removal direction from the retaining device and the operating part of the rocker is operated in a direction perpendicular to the removal direction.

39. The method according to claim 34, wherein the electronic component has a surface and the operating part is operated in a direction perpendicular to the surface of the electronic component.

40. The method according to claim 35, the rocker being rotated about a rotation axis located between the unlocking part and the operating part of the rocker.

41. The method according to claim 35, wherein the unlocking part of the rocker, when the rocker is moved to the operated position, changes its position with respect to a housing wall of the retaining device.

42. The method according to claim 35, wherein the unlocking part of the rocker, when the rocker is moved to the operated position, changes interaction with the retaining device.

* * * * *